United States Patent [19]

Curington

[11] 3,991,834

[45] Nov. 16, 1976

[54] SAMPLING AIRHAMMER APPARATUS

[76] Inventor: Alfred R. Curington, Rte. 1, Brookgreen Drive, Inman, S.C. 29349

[22] Filed: July 7, 1975

[21] Appl. No.: 593,738

[52] U.S. Cl. ..... 173/73; 173/80; 175/215

[51] Int. Cl.[2] ..... E21B 5/00

[58] Field of Search ..... 173/63, 64, 78, 80, 173/100, 73, 74; 175/215, 325

[56] References Cited

UNITED STATES PATENTS

| | | | |
|---|---|---|---|
| 3,155,179 | 11/1964 | Hunt et al. | 175/215 |
| 3,439,757 | 4/1969 | Elenburg | 175/215 |
| 3,638,742 | 2/1972 | Wallace | 175/215 |
| 3,667,555 | 6/1972 | Elenburg | 175/215 |

*Primary Examiner*—James A. Leppink

[57] ABSTRACT

A rotatable airhammer including an outer housing structure in which a hollow hammer piston is reciprocable to impact against an anvil bit used in drilling a bore hole. The anvil bit has a central passage communicating with inner core sample tubing extending through the piston to the upper end of the housing structure, such tubing housing structure being connectible to a string of concentric dual drill pipe extending to the top of the bore hole. Compressed air is directed alternately to the annular space between the tubing and housing structure above and below the piston to reciprocate the latter for repeated impact action against the anvil bit, air being discharged from the lower portion of the housing structure to clear the bottom of the bore hole of cuttings and direct them into the central passage through the bit, the inner tubing and inner drill pipe portion to the top of the hole. A gauge sleeve is mounted on the housing structure a short distance above the lower end of the anvil bit, exhaust air from the airhammer being directed into the bore hole immediately above and below the sleeve to provide a static air seal preventing cuttings from passing upwardly around the sleeve, insuring passage of all cuttings into the central bit passage. Exhaust air is also directed into the bore hole at a distance above the gauge sleeve to blow bore hole debris externally of the housing structure and drill pipe upwardly through the annulus around the drill pipe to the top of the bore hole.

21 Claims, 14 Drawing Figures

SAMPLING AIRHAMMER APPARATUS

The present invention relates to apparatus for sampling cuttings produced in the drilling of bore holes in formations, and more particularly to apparatus in which cutting samples are conveyed continuously to the top of the bore hole as drilling of the bore hole proceeds.

A formation sampling system now being used includes a string of concentric inner and outer drill pipes or tubular members and a conventional airhammer. A sub is placed between the airhammer and the drill pipe which serves to pack off the annulus above the airhammer by means of a close fit to the drilled hole. Crossover ports in the sub below the packed-off region direct the cuttings coming up the annulus between the airhammer and the bore hole wall into the inner tubing of the concentric drill pipe, through which they are conveyed to the top of the bore hole and collected.

Because some of the material to be recovered is in the form of very fine particles, it is necessary to prevent upward flow past the packoff from occurring. This is normally accomplished by either sealing off the annulus at the surface or top of the bore hole, or loading the hole with drilling mud. With both of these methods, there is always the danger of sticking the drilling string in the hole. Since there is no flow in the annulus between the lower packoff and the top of the hole, any formation particles which fall in the hole from above the lower packoff region collect above the packoff, frequently locking the airhammer and drill pipe in the hole. False survey information also results due to fine formation particles from above the packoff falling past it and contaminating the sample entering the inner tubular portion of the concentric drill pipe. The method and apparatus for formation sampling has the disadvantage of requiring the driller to be equipped to handle the drilling mud or annulus sealing equipment. Moreover, the foregoing system and apparatus, which results in sticking of the drill pipe in the hole, frequently causes loss of drill pipe, which is very expensive.

By virtue of the present invention, the aforenoted difficulties with prior formation sampling systems, and particularly those embodying airhammers, are eliminated. A gauge sleeve of slightly less diameter than the diameter of the bore hole being produced is incorporated in the apparatus just above the drill bit, and a static seal provided at the gauge sleeve by directing air to the apparatus immediately above and below the gauge sleeve, which creates a stagnant area adjacent to the gauge sleeve through which flow of air does not occur. Since there is no flow in either direction past the static seal, all cuttings from the bore hole bottom are directed by the air discharged into the bottom of the bore hole into the central portion of the bit, from where it passes upwardly through a central tubular structure and into the inner tubing of a concentric dual drill pipe string to the top of the bore hole.

All debris that might drop off the formation wall is prevented from dropping to the location of the gauge sleeve by compressed air discharged from the apparatus which blows such debris upwardly through the annulus to the top of the bore hole, thereby keeping the hole clean and preventing sticking of the drill pipe string. Such cleaning action also prevents the debris from dropping downwardly to the region of the gauge sleeve and past the gauge sleeve, where it could contaminate the sample produced by the drill bit, interfering considerably with the reliability of the sample produced and carried up the inner tubular portion of the apparatus to the top of the well bore. Thus, a more reliable sample is obtained. The overcoming of the potential problem of drill pipe sticking in the bore hole lessens the risk of losing equipment which is quite costly. With the present apparatus, the driller has no special equipment to contend with other than that necessary to handle a dual string of drill pipe. More specifically, the driller does not have to contend with the handling of drilling mud or annulus sealing equipment.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings:

FIGS. 1*a*, 1*b*, 1*c* and 1*d* together constitute a longitudinal section through an apparatus embodying the invention, with the parts in one relative position, FIGS. 1*b*, 1*c* and 1*d* constituting lower continuations of FIGS. 1*a*, 1*b* and 1*c*, respectively;

FIGS. 2*a* and 2*b* are views corresponding to FIGS. 1*b*, 1*c* and 1*d*, with the parts in another relative position, FIG. 2*b* being a lower continuation of FIG. 2*a;*

FIGS. 3*a* and 3*b* are views similar to FIGS. 2*a* and 2*b*, with the parts in still another relative position, FIG. 3*b* being a lower continuation of FIG. 3*a;*

Figure 1A:
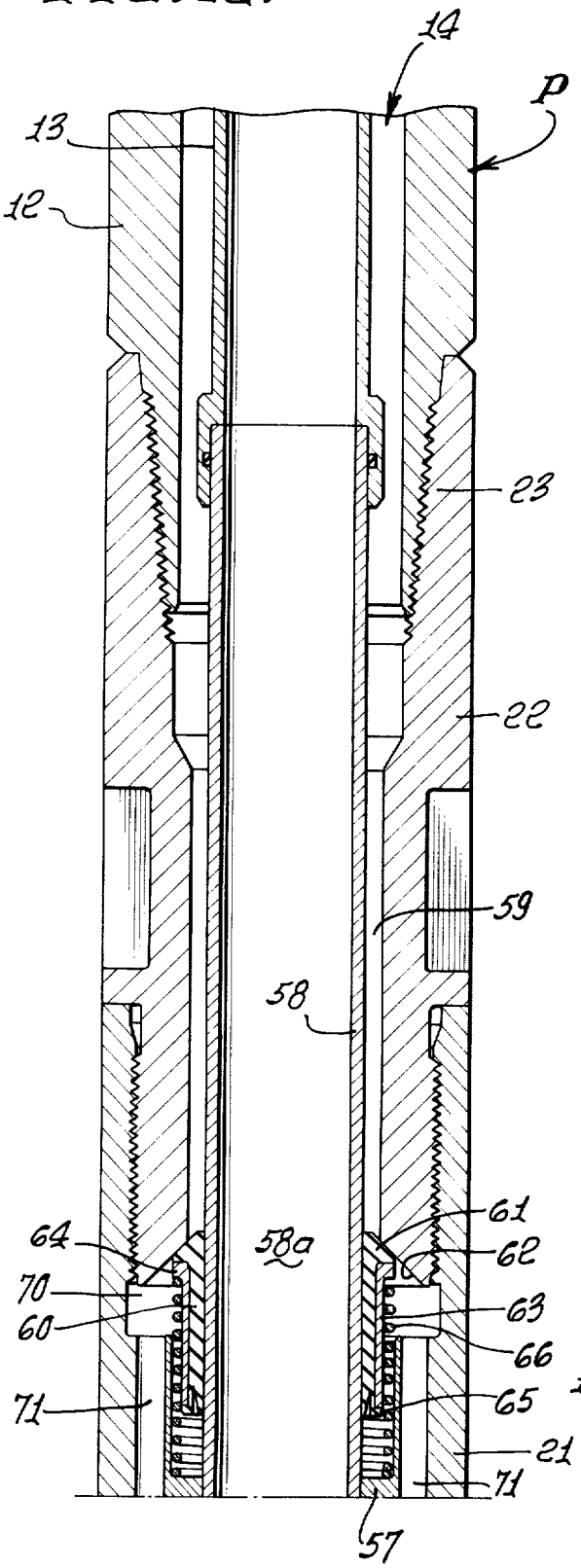

Disclosed in the drawings is a sampling airhammer apparatus, the lower end of which includes a pneumatically driven hammer bit 10 which is preferably integral with an anvil 11. The upper end of the apparatus is connected to a string of concentric dual drill pipe P extending to the top of the bore hole H being drilled. The concentric drill pipe string includes an outer drill pipe 12 and an inner drill pipe 13 spaced from the inner wall of the outer pipe to provide an annular passage 14 therebetween extending to the top of the bore hole to a swivel (not shown), the swivel including a portion for rotating the drill pipe string and the airhammer apparatus, while the bit is impacted repeatedly against the bottom C of the bore hole. The concentric drill pipe string can be of any suitable type, as well as the swivel. An example of such apparatus is illustrated in U.S. Pat. No. 3,871,486, patented Mar. 18, 1975.

The airhammer apparatus includes the integral anvil bit 11, 10 referred to above, the anvil and bit having a central passage 15 therethrough opening through the end of the bit through one or a plurality of passage 16, 16 through which the samples being produced can be directed by compressed air into the central passage. The lower face of the bit has a plurality of tungsten carbide buttons 17 secured therein for impacting against the bottom of the bore hole, to produce the cuttings which are caused to flow by compressed air into the central bit passage 15. During the operation of the airhammer apparatus, the bit is rotated so that the buttons 17 collectively impact against substantially the entire cross-sectional area of the bottom of the bore hole.

The anvil bit extends upwardly through a tubular drive member 18 forming part of a housing structure 19, which comprises an external elongate housing 20 threadedly secured to the member 18, and the upper end of which is threadedly secured to a coupling 21, which is, in turn, threadedly attached to a top sub 22 having an upper threaded box 23 for threaded attachment to the lower end of the outer drill pipe 12 of the dual concentric string. The lower portion of the drill bit extends below the lower end of the drive member 18, which, for example, may be for a distance of about 4 inches. A gauge sleeve 24 surrounds the lower portions of the housing 20 and drive member 18, this sleeve having an inwardly directed flange 25 clamped between the lower end of the housing 20 and an upwardly facing shoulder 26 on the drive member. The clamping action results from the threaded attachment of the drive member 18 to the housing 20.

The anvil portion 11 of the anvil bit has circumferentially spaced longitudinal recesses 27 therein, in which drive segments 28 are disposed of substantially shorter length than the length of the recesses, these segments extending through companion windows 29 in the drive member and being held in appropriate position by the inner wall 30 of the housing. Rotation of the drill pipe string P and housing structure 19 is transmitted through the drive member 18 and segments 28 to the anvil bit 11, 10, while a tubular hammer piston 31, disposed within the housing structure, repeatedly impacts against the upper end 32 of the anvil to force the bit buttons 17 into the formation and produce the cuttings.

The housing structure further includes an elongate cylinder sleeve 33 disposed within the housing portion 20, the lower end of which engages a shoulder 34 on a seal sleeve 35 that carries an elastomer seal 36 bearing against the upper end of the drive member 18. A seal ring 37 bears against the upper end of the seal sleeve and slidably seals against the periphery 38 of the upper portion of the anvil, the outer surface of the seal engaging the inner surface 39 of the cylinder sleeve. An upper ring 40 is held against the seal by a suitable split retainer ring 41 mounted in an internal groove 42 in the cylinder sleeve and engaging the upper ring. It is to be noted that the upper end portion 43 of the anvil is of a reduced diameter with respect to the diameter of the periphery engaged by the seal 37 to provide an annular passage 44 when the parts are in the position disclosed in FIG. 3*b*.

The upper portion of the cylinder sleeve has an internal upwardly facing shoulder 45 bearing against the end of a stepped sleeve 46 (FIG. 1*b*) having an upper shoulder 47 engaging an elastomer annular gasket 48 bearing against the lower end of the coupling 21.

An inner portion 49 of the stepped sleeve has its upper end bearing against a lower elastomer gasket 50, which, in turn, bears against a lower ring 51 of a seal structure, this lower ring bearing against the end of an elastomer seal ring 52 with its upper portion 53 disposed within the inner portion of this seal ring. The seal ring 52 bears against the lower end of an upper ring 54 and against the periphery of a depending skirt 55 of the upper ring, the upper ring itself bearing against an elastomer gasket 56, which, in turn, bears against a downwardly facing shoulder of a flange 57 of the coupling 21.

The lower portion of an inner core tubing 58, which is concentric with the housing structure 19, has its lower end brazed to the upper ring 54 of the seal structure, the upper seal ring 56 sealingly engaging the periphery of the inner tubing. This tubing provides an annular space 59 with the top sub 22 and upper portion of the coupling above its flange 57, in which a valve member 60 is disposed. This valve member is made of an elastomer material, such as hard rubber, which is slidably and sealingly engageable with the periphery of the inner core tubing 58 and which has a valve head 61 bearing against a tapered valve seat 62 formed on the lower end of the top sub 22. A reinforcing sleeve 63 surrounds the elastomer valve member, this sleeve having an outwardly directed flange 64 bearing against the lower end of the valve head 61, the elastomer seal having an outwardly directed lower flange 65 bearing against the end of the reinforcing member 63. A helical compression spring 66 surrounds the valve member, the lower end of the spring bearing against the coupling flange 57 and the upper end bearing against the flange 64 of the valve reinforcing member, to urge the valve head 61 against its companion seat 62.

Compressed air in the annular space 14 between the inner and outer drill pipe sections 13, 12 can flow downwardly through the annular space 59 between the top sub and the inner core tubing to shift the valve member 60 downwardly to open the valve, the compressed air then passing into an annular space 70 surrounding the valve member, and then into a plurality of longitudinal passages 71 extending through the coupling to its lower end, where such passages open into an annular groove 72 between the lower portion of the coupling 21 and the upper portion of the surrounding housing 20.

An elongate core tube 73 extends upwardly through the stepped seal member 46, bearing against a downwardly facing shoulder 74 of the lower seal ring 51, the upper end of this tube being suitably secured to the lower ring 51, as by brazing it thereto. The lower rubber gasket 50 seals against the periphery of the inner core tubing. The lower portion of the elongate inner core tubing 73 encompasses a core tube section 75, which may be made of a suitable plastic material, which has its lower flange 76 received within a companion groove 77 in the upper portion of the anvil 11, the tube section being in slidable sealed relation to the lower portion of the core tubing. Thus, the interior of the airhammer apparatus has a passage 16, 15, 75*a*, 73*a*, 58*a* extending from the lower face of the bit upwardly to the upper end of the inner core tubing 58, which is suitably secured to the inner pipe or tubing 13 of the concentric dual drill pipe string, which extends to the top of the well bore.

Figure 1C:
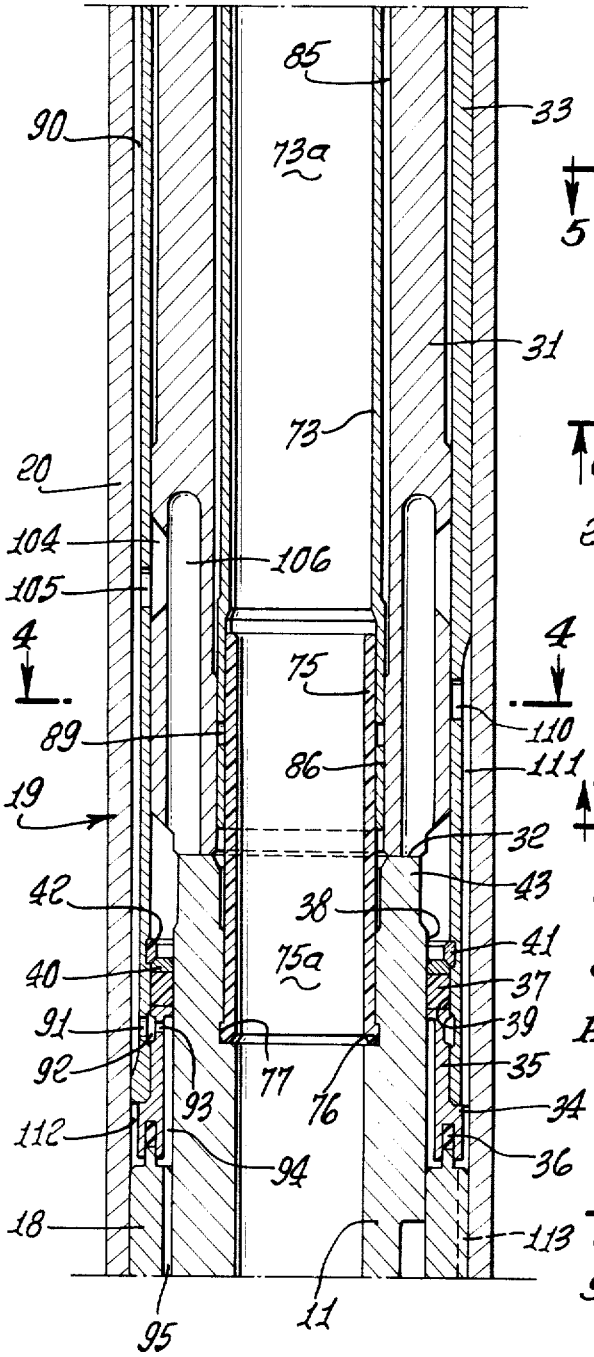
Figure 2A:
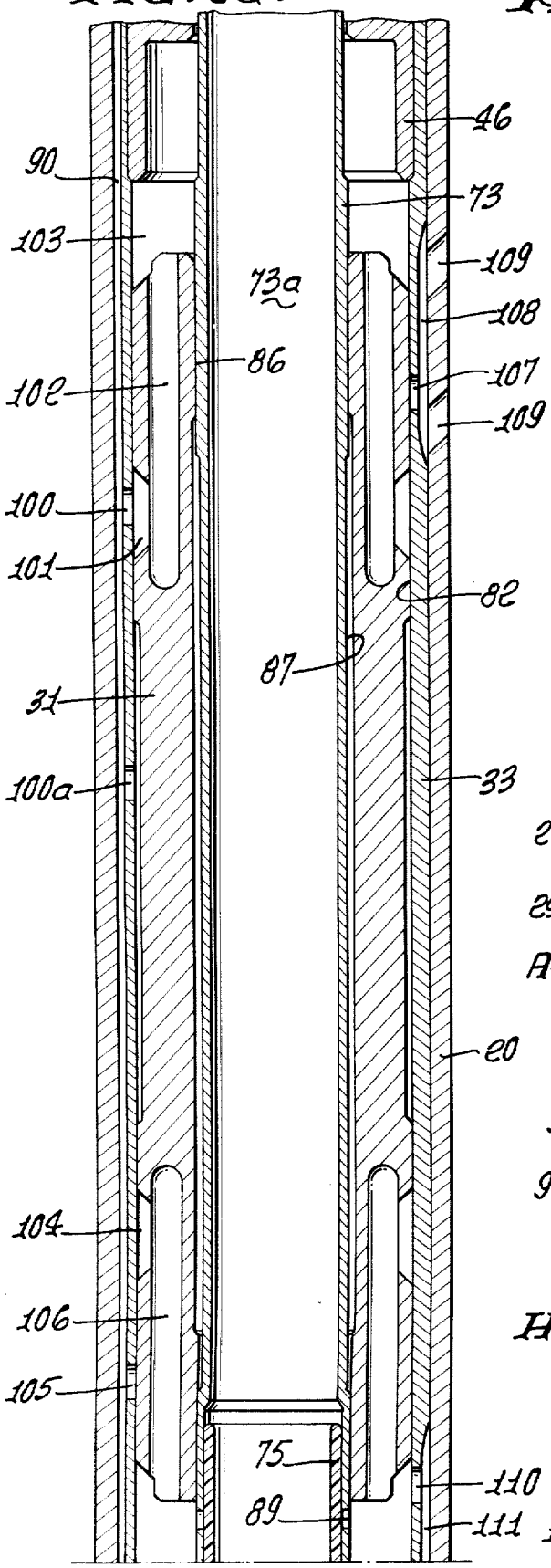
Figure 3A:
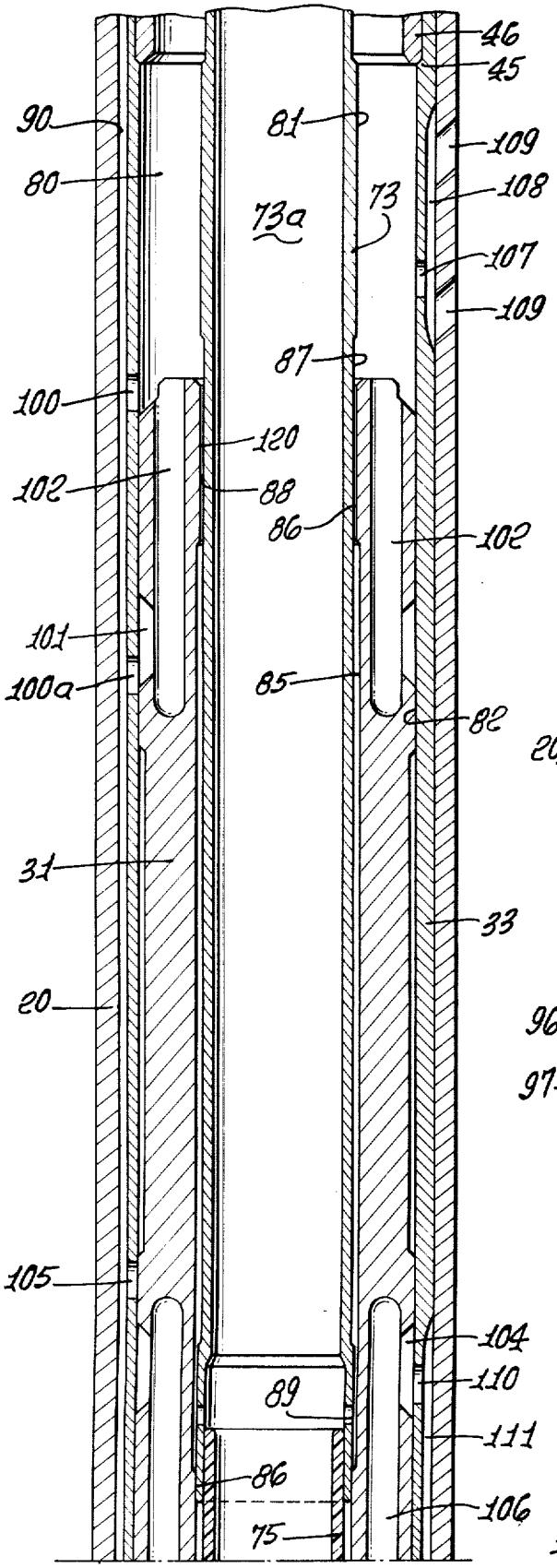
Figure 3B:
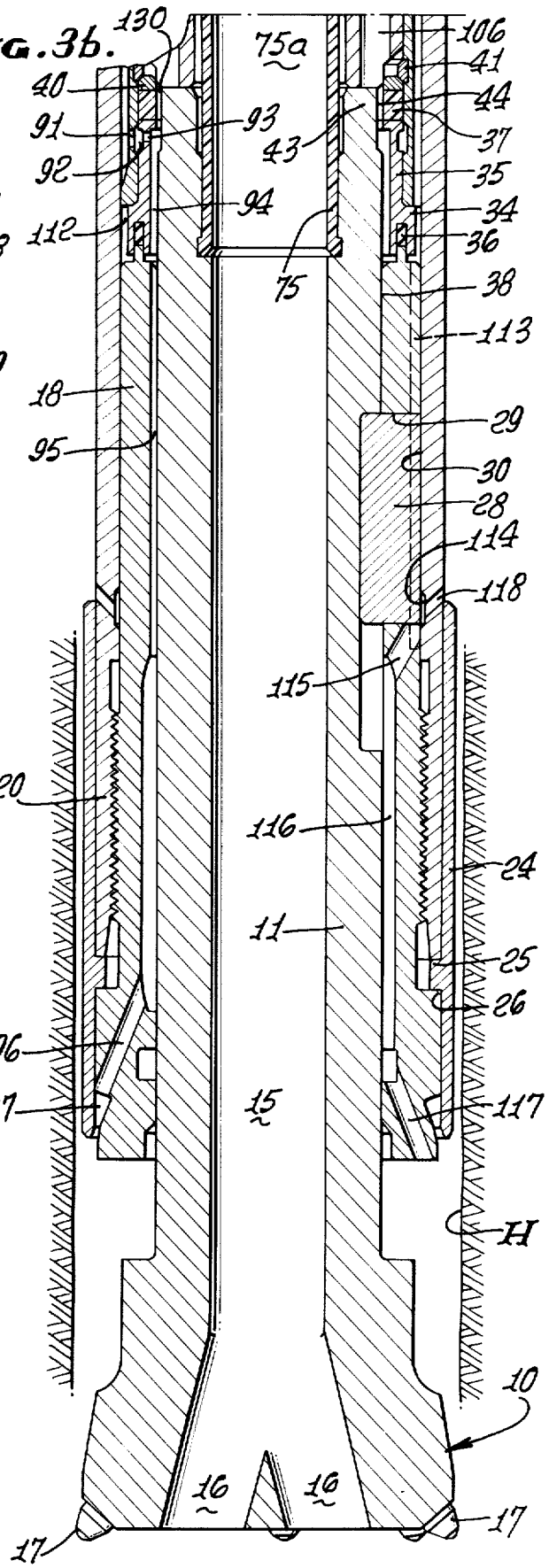
Figure 4:
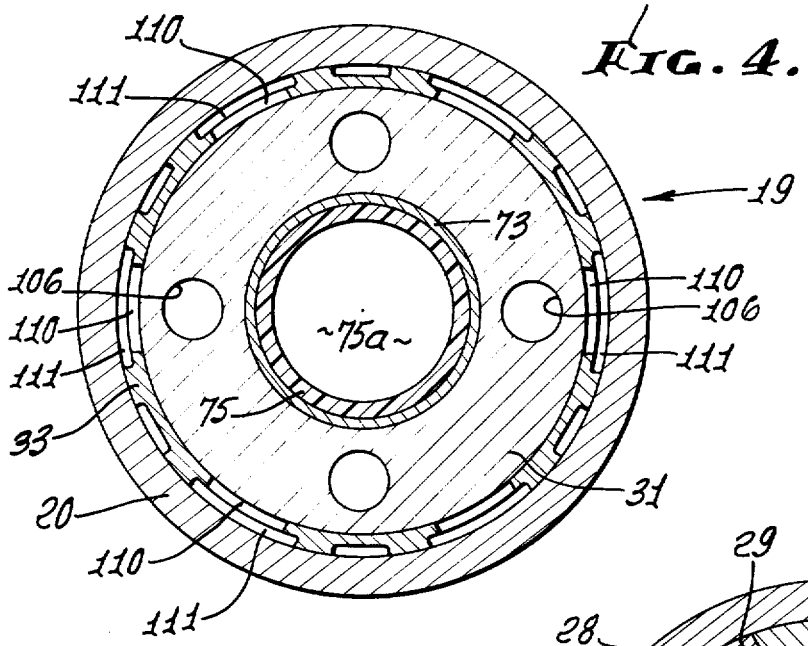
FIG. 4 is a cross-section taken along the line 4—4 on FIG. 1*c;*

The airhammer piston 31 is disposed in the annular space 80 between the inner core tubing 73 and the elongate cylinder sleeve 33, being in slidable sealing arrangement with the periphery 81 of the core tubing and with the inner wall 82 of the cylinder sleeve, except for certain relieved portions in the hammer piston and in the inner wall. Between its upper and lower portions, the hammer piston has an internal surface 85 of enlarged diameter, as compared with the inner surfaces 86 of the end portions, providing a relieved portion 85, and the inner core tubing has a relieved portion 87 of lesser diameter than the adjacent peripheral diameters 81 of the inner core tube, to provide an annular passage 88 for a purpose to be described below (FIGS. 3*a*, 3*b*). The lower portion of the inner core tube has a plurality of ports 89 which are normally closed by the core tube section 75, as disclosed in FIGS. 1*c*, 2*a*. However, when the anvil bit 11, 10 is permitted to drop partially out of the housing structure, as, for example, when the apparatus is elevated from the bottom of the bore hole, the lower end of the core tube section 75 is disposed below the ports 89, opening them to permit passage of air to the interior of the core tube, as described below.

The cylinder sleeve 33 has an inlet passage 90 extending from its upper end, in communication with the groove 72, to a port 91 in its lower end which communicates with a peripheral groove 92 of the seal sleeve 35, which has circumferentially spaced lateral chokes or ports 93 opening into the annular space 94 between the periphery of the anvil 11 and the seal sleeve. From this annular space, compressed air can flow through elongate passages 95 in the interior of the drive member 18 between the drive member keys 28, which open into a plurality of discharge ports or holes 96 in the lower portion of the drive member, and into an annular space 97 between the lower portion of the seal sleeve 24 and the drive member below the ends of the ports. The compressed air then flows into the bore hole H to sweep the cuttings produced on the bottom of the hole around the bit drilling face and into the passages 16, 15 through the anvil bit. During operation of the apparatus, air is constantly being pumped through the path just described for discharge around the lower end of the bit to carry the cuttings upwardly into the passages 16, 15 and through the entire inner tubing structure 75, 73, 58 to the inner tubing 13 of the concentric drill pipe string P.

High pressure air from the inlet passage 90 can also flow through an upper inlet port 100 in the cylinder sleeve opening to its interior. When a peripheral annular groove 101 in the upper portion of the hammer piston 31 is aligned with the port 100, such air can flow into a longitudinal impact passage 102 and into the cylinder space 103 above the piston, driving the latter downwardly on its power stroke into striking engagement with the upper end of the anvil 11. When the piston is at the lower end of its power stroke (FIGS. 1*b*, 1*c*), its groove 101 is closed by the piston and a lower piston groove 104 communicates with a cylinder inlet port 105, communicating with the inlet passage 90. Air flows from the passage 90, inlet port 105 and groove 104 into longitudinal return passages 106 opening through the lower end of the hammer piston 31, for the purpose of driving the piston upwardly of the housing structure and tubing 73 on the return stroke of the piston. When the piston is at the lower end of its stroke, it opens an upper exhaust port 107 in the cylinder sleeve communicating with a longitudinal groove 108, the air discharging through exhaust ports 109 in the housing, preferably inclined in an upward direction, to sweep debris or other cuttings that may have fallen into the bore hole from the formation walls, upwardly through the annulus around the outer drill pipe sections P to the top of the bore hole.

Figure 5:
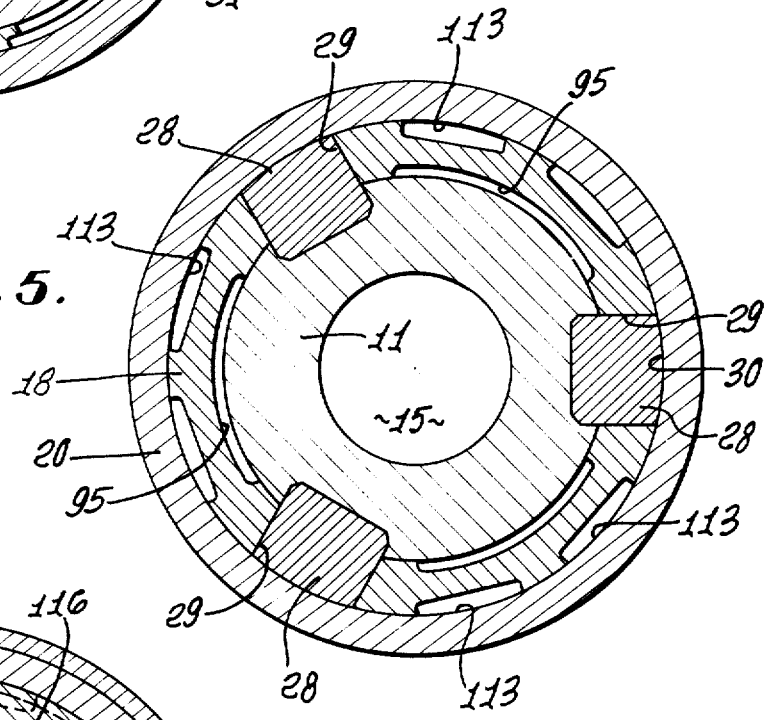
FIG. 5 is a cross-section taken along the line 5—5 on FIG. 1*d;*
Figure 6:
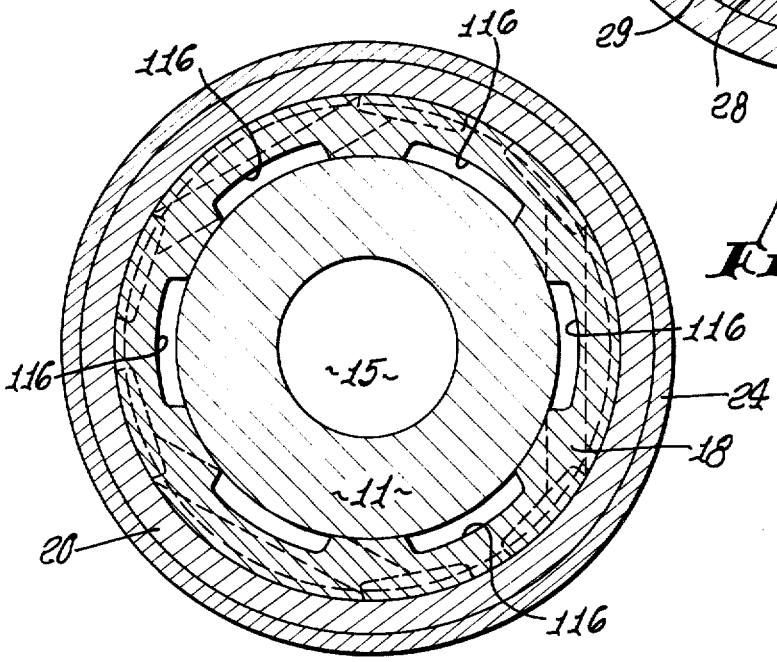
FIG. 6 is a cross-section taken along the line 6—6 on FIG. 1*d;*
Figure 7:
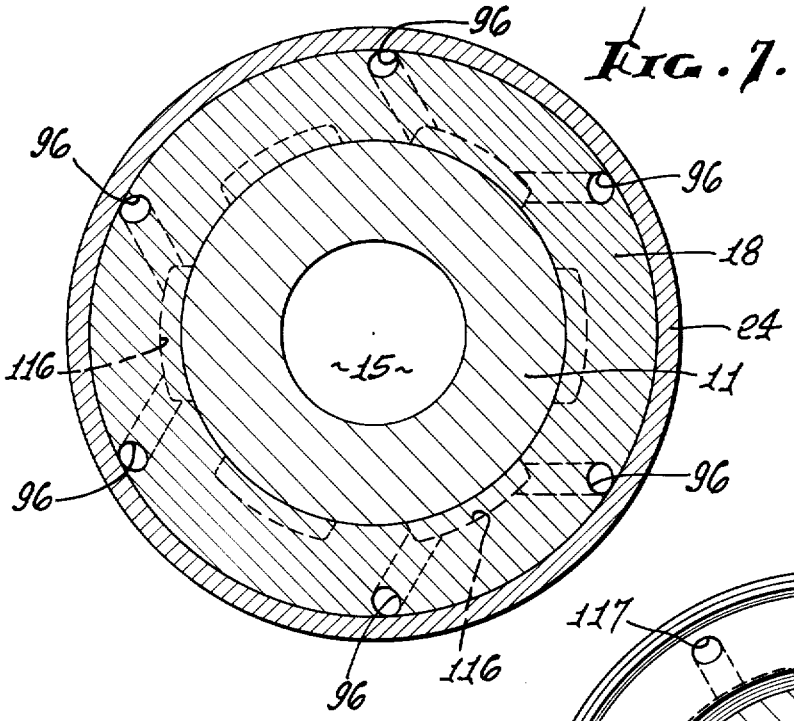
FIG. 7 is a cross-section taken along the line 7—7 on FIG. 1*d;*
Figure 8:
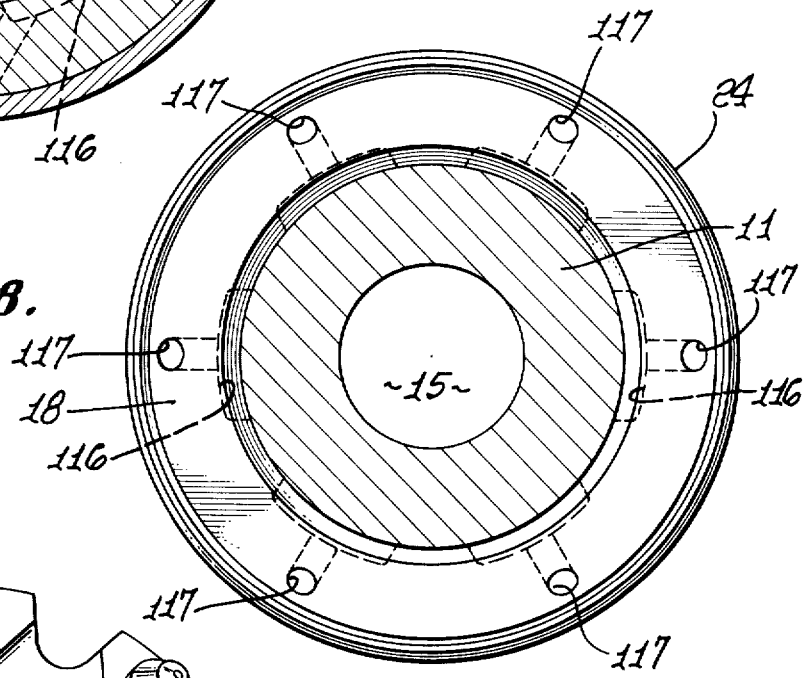
FIG. 8 is a cross-section taken along the line 8—8 on FIG. 1*d.
Figure 9:
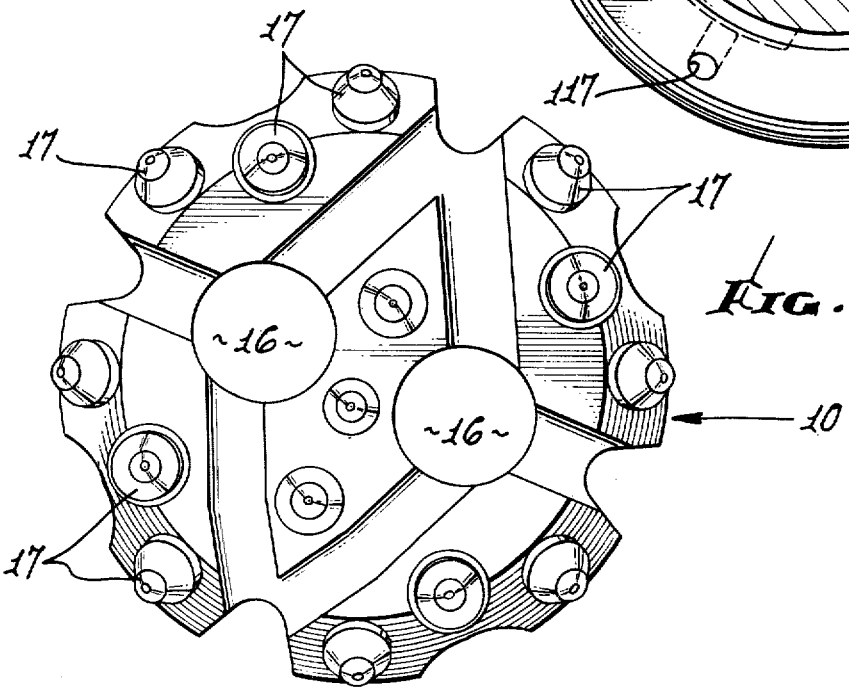
* and FIG. 9 is a bottom plan view taken along the line 9—9 on FIG. 1*d.*

Exhaust ports 110 are also provided in the lower portion of the cylinder, which communicate with downwardly extending exhaust passages 111 opening into an annular space 112 around the seal sleeve 35, from where the exhaust air can flow through circumferentially spaced longitudinal passages 113 (FIG. 5) formed in the exterior of the drive member 18, these passages communicating with a circumferential groove 114 provided between the housing 20 and the drive member 18, the exhaust air being capable of flowing through exhaust ports 115 in the drive member into circumferentially spaced exhaust passages 116 that communicate with downwardly and laterally outwardly inclined exhaust ports 117 that discharge into the bore hole below the lower end of the gauge sleeve 24. Circumferentially spaced exhaust ports 118 inclined in a laterally outward and upward direction also conduct exhaust air into the bore hole immediately above the upper end of the gauge sleeve 24. Both upper and lower sets of exhaust ports are of such areas as to provide substantially the same pressure at opposite ends of the gauge sleeve 24, which has an external diameter slightly less than the diameter of the bore hole H produced by the bit, thereby resulting in an area of stagnant or immovable air around the gauge sleeve, and between its upper and lower ends, to provide a static seal at the gauge sleeve. Accordingly, all of the air discharged through the high pressure air ports 96 will sweep along the lower wall of the bore hole and across its drilling face to convey the cuttings upwardly through the bit passages 16, 15 and through the inner tubes 75, 73, 58, 13 to the top of the well bore. No cuttings will be carried past the exterior of the gauge sleeve 24 into the annulus A surrounding the airhammer apparatus and the drill pipe thereabove.

Figure 1B:
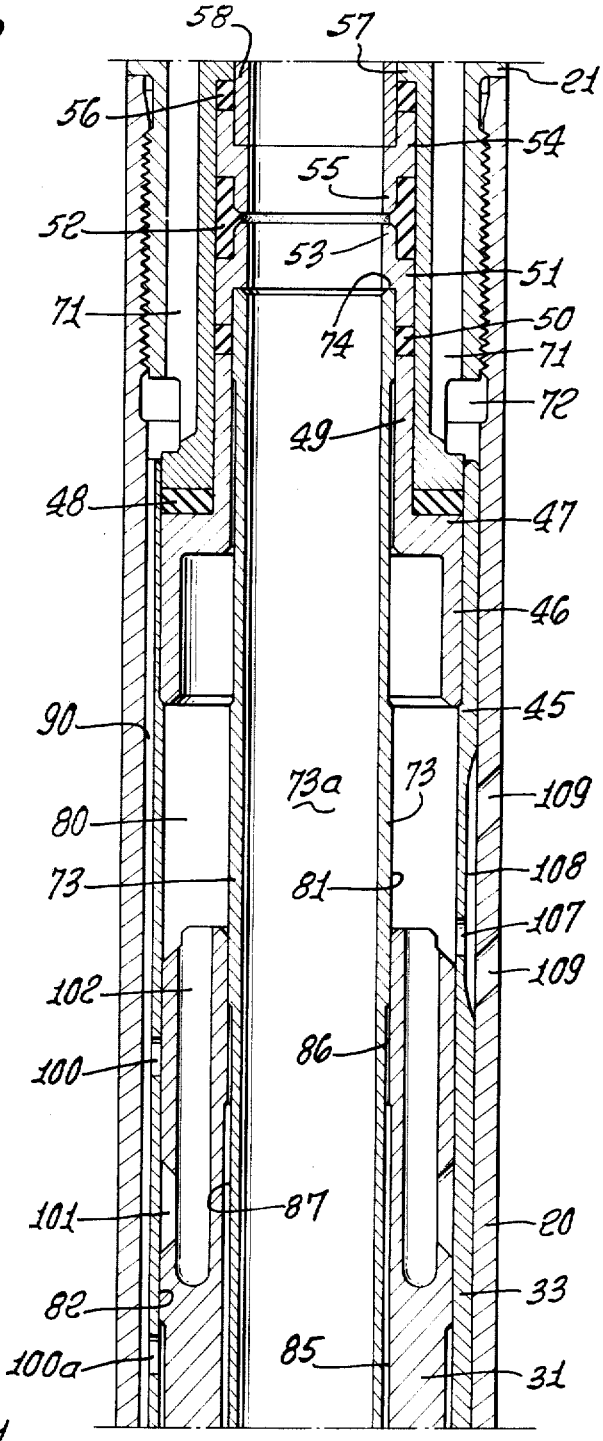
Figure 1D:
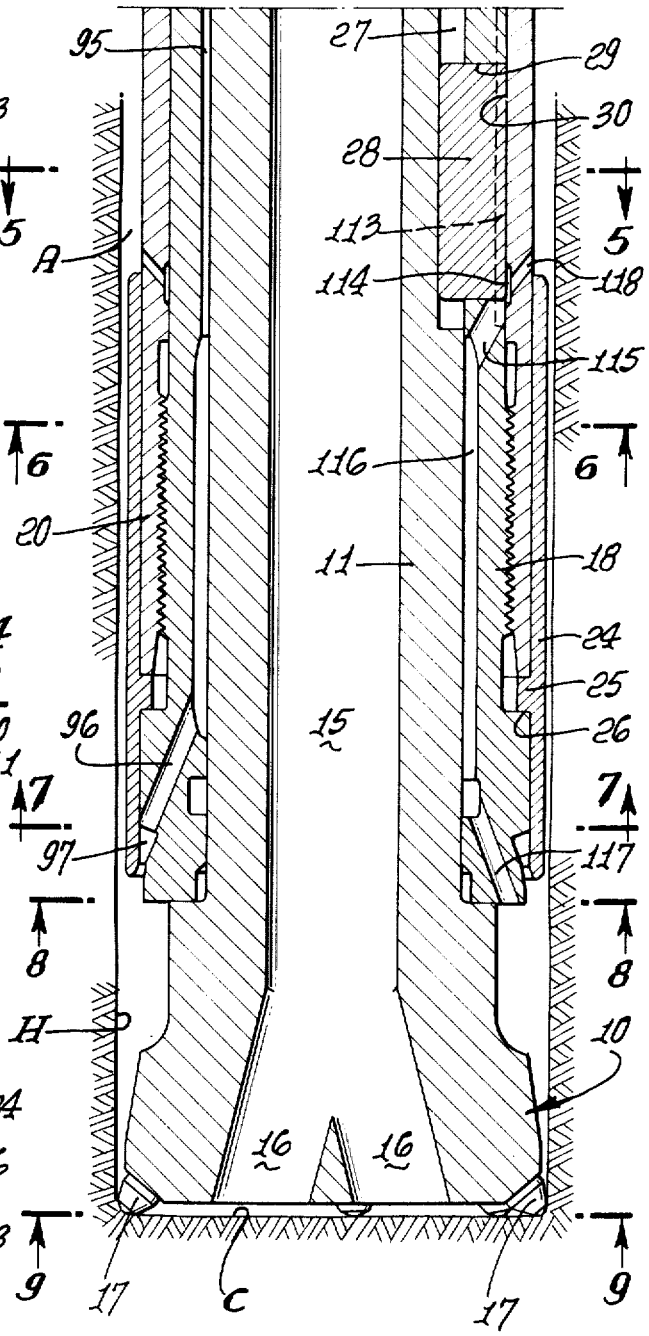
Figure 2B:
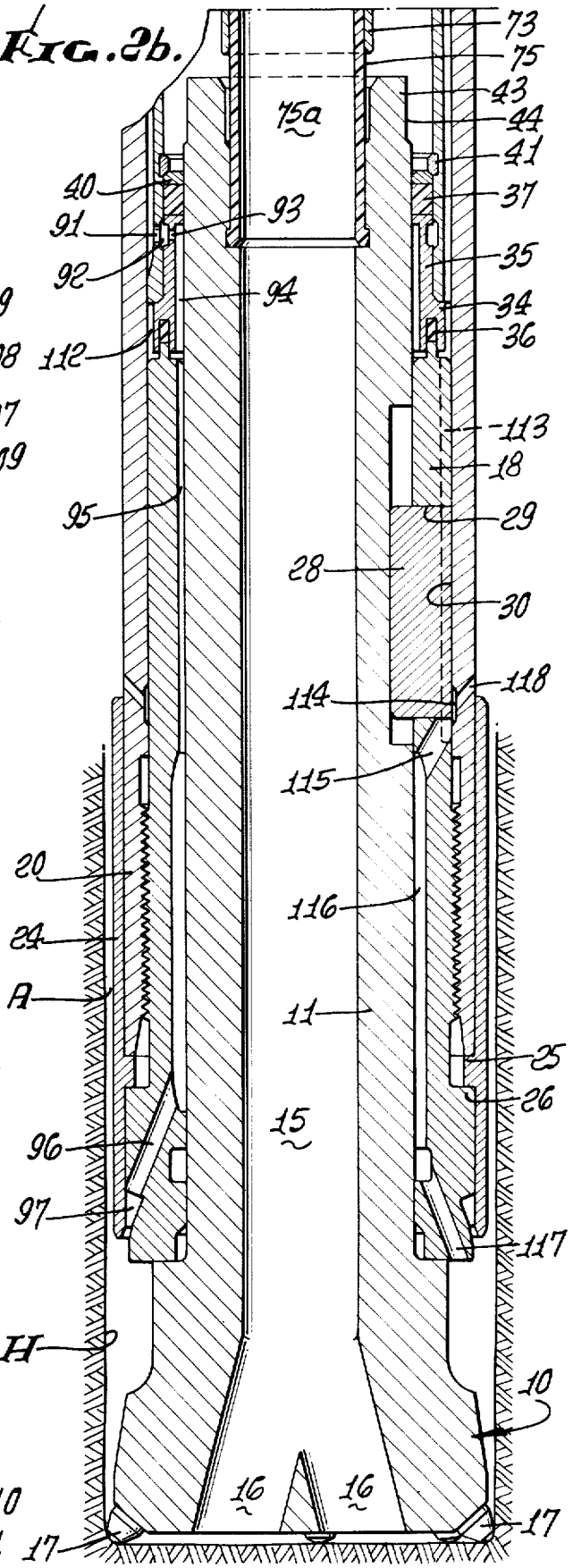

The apparatus is illustrated in FIGS. 1*a* and 1*d* with the parts in condition in which the hammer piston 31 is at the end of its hammer stroke upon the anvil 11. At this time, the upper inlet ports 100 are closed by the upper end of the piston. However, the lower inlet port 105 is in communication with the return piston passages 106, so that compressed air will travel into the lower end of the cylinder sleeve 33 below the piston to move such piston upwardly on its return stroke. After the upwardly moving piston has covered the lower inlet port 105, further delivery of compressed air to the lower portion of the cylinder ceases, the piston moving upwardly as a result of expansion of the lower compressed air until the upper annular groove 101 is disposed across the upper inlet port 100, which then directs the high pressure air through the impact passage 102 to the cylinder space above the piston. As the piston moves upwardly, its lower end exposes the exhaust ports 110, the compressed air below the piston then flowing through the exhaust passages 113, 114, 115, 116 and discharging through the upper and lower exhaust ports 118, 117 at opposite ends of the gauge sleeve 24 to create the region of static flow around such gauge sleeve. The parts are then in the position illustrated in FIGS. 2*a*, 2*b*.

The hammer piston 31 is then moved downwardly by the high pressure air on its power stroke, the lower inlet port 105 having been closed by upward movement of the piston. Before the piston reaches the end of its power stroke, the upper inlet port 100 is closed by the piston. However, as it nears the end of its power stroke, it moves downwardly below the upper exhaust ports 107, the high pressure air then exhausting through the housing ports 109 into the surrounding bore hole, the compressed air then flowing upwardly through the annulus A surrounding the string of drill pipe P to the top of the bore hole, carrying any debris or other substances in the well bore upwardly with it to the top of the hole. The parts are then again in the position illustrated in FIGS. 1*a* to 1*d*. The foregoing cycle of operation is then repeated.

Upon elevating the airhammer apparatus by the string of drill pipe P, the anvil 11 and bit 10, the inner tube extension 75 secured to the upper portion of the anvil, and the piston 31 will drop downwardly to the extent determined by engagement of the anvil with the upper ends of the drive segments 28, the parts reaching the position illustrated in FIGS. 3*a*, 3*b*. At this time, the upper end of the hammer piston has moved below its sealed relation with the inner tube, the upper inner surface 120 of the piston then being spaced laterally from the reduced diameter portion 87 of the inner tube, and providing an annular passage through which the compressed air from the inlet passage 90 can flow through both upper and lower inlet ports 100, 100*a*, such compressed air discharging through the lateral housing ports 109 into the annulus around the apparatus. Some of the compressed air flowing through the annular passage 88, 87 between the piston 31 and inner tube 73 can then flow through the lower lateral ports 89, which have been uncovered by the fact that the upper end of the tube extension 75 is disposed below such ports (FIG. 3*a*), and into the interior of the inner tube, the compressed air flowing upwardly through the inner tube 73 to carry any debris or substances therefrom through the inner tube structure to the top of the bore hole for suitable disposal. The apparatus, therefore, has the capability of preventing plugging or jamming of the inner tubing structure with cuttings. At all times, the high pressure compressed air can flow through the high pressure passage 90 for discharge through the lower ports or nozzles 96 into the bore hole below the gauge sleeve 24. The gauge sleeve will restrict or prevent the flow of such compressed air around its exterior, since some compressed air can flow from the high pressure passage 90 through its ports 91, 93 into the space 130 between a reduced diameter upper portion 43 of the anvil and the side seal 37, which is then spaced from the periphery of the reduced diameter portion (FIG. 3*b*). From this space, the air flows into the return passages 106 and the groove 104, which communicates with the exhaust port 110, from where the air flow continues through the passages 111, 113, 114, 118 and 115, 116, 117 into the bore hole above and below the seal sleeve 24.

When the drilling operation is to proceed, the apparatus is lowered until the bit 10 engages the bottom of the bore hole, whereupon the parts are then returned to the position illustrated in FIGS. 1*a* to 1*d*. The flow of compressed air through the annular space 14 will insure the opening of the upper check valve 60 and the reciprocation of the airhammer piston, the apparatus being rotated at the desired speed during the repeated impacting action of the hammer or piston 31 against the anvil 11 to insure that substantially the full area of the bottom of the bore hole is impacted upon by the bit buttons 17, the compressed air carrying the cuttings into the tool passages 16, 15 for upward passage therethrough to the top of the well bore. The formation samples received from the bottom of the bore hole are uncontaminated.

The exhaust air is always flowing upwardly through the annulus A surrounding the apparatus and the drill pipe to maintain the hole clear of debris and to prevent the drill pipe and the hammer apparatus from sticking, which, as noted above, sometimes results in loss of costly drill pipe. There is no need to fill the bore hole annulus with drilling mud, nor is it necessary to use any annulus sealing equipment, which makes it unnecessary for the driller to be concerned with such materials or proper operation of the equipment. It is necessary for the driller to handle the dual pipe string P in the usual manner, with assurance that uncontaminated samples of material are secured, such samples representing the full amount of the cuttings produced by the impact bit.

I claim:

1. Apparatus for obtaining formation samples from the bottom of a bore hole: an outer housing structure having means thereon for securing said structure to a tubular drill string; bit means connected to said housing structure for producing formation cuttings to drill the bore hole to a desired diameter; said bit means having a sample passage therethrough for receiving the formation cuttings and for conducting such cuttings upwardly toward the tubular drill string; means for discharging fluid into the bore hole in the region of the bit means to convey the formation cuttings into said sample passage; seal means on the lower portion of said housing structure above the lower end of said bit means and having a diameter substantially corresponding to the diameter of the bore hole; and means for directing fluid from the interior of said housing structure into the bore hole externally of said housing structure adjacent and simultaneously to the upper and lower ends of said seal means to provide a zone of substantially static fluid around said seal means creating a fluid barrier to the movement of formation cutting past said seal means.

2. Apparatus as defined in claim 1; and means above said fluid directing means for conducting fluid through said housing structure into the bore hole around said housing structure for upward movement around said housing structure and the tubular drill string.

3. Apparatus as defined in claim 1; tubular means within said housing structure communicating with said samples passage to form an upward extension thereof; first means external of said tubular means for conducting fluid to said fluid discharging means; and second means external of said tubular means and bit means for conducting fluid to said fluid directing means.

4. Apparatus as defined in claim 1; tubular means within said housing structure communicating with said sample passage to form an upward extension thereof; first means external of said tubular means for conducting fluid to said fluid discharging means; and second means external of said tubular means and bit means for conducting fluid to said fluid directing means; and means above said fluid directing means for conducting fluid through said housing structure into the bore hole around said housing structure for upward movement around said housing structure and the tubular drill string.

5. Apparatus for obtaining formation samples from the bottom of a bore hole: an outer housing structure having means thereon for securing said structure to a tubular drill string; bit means connected to said housing structure for producing formation cuttings to drill the bore hole to a desired diameter; said bit means having a sample passage therethrough for receiving the formation cuttings and for conducting such cuttings upwardly toward the tubular drill string; means for discharging fluid into the bore hole in the region of the bit means to convey the formation cuttings into said sample passage; seal means on the lower portion of said housing structure above the lower end of said bit means and having a diameter substantially corresponding to the diameter of the bore hole; and means for directing fluid into the bore hole externally of said housing structure adjacent to the upper and lower ends of said seal means to provide a zone of substantially static fluid around said seal means creating a fluid barrier to the movement of formation cuttings past said seal means; said seal means comprising a sleeve secured to said housing structure; said fluid directing means discharging fluid into the bore hole immediately above and below the upper and lower ends, respectively, of said sleeve.

6. Apparatus for obtaining formation samples from the bottom of a bore hole: an outer housing structure having means thereon for securing said structure to a tubular drill string; bit means connected to said housing structure for producing formation cuttings to drill the bore hole to a desired diameter; said bit means having a sample passage therethrough for receiving the formation cuttings and for conducting such cuttings upwardly toward the tubular drill string; means for discharging fluid into the bore hole in the region of the bit means to convey the formation cuttings into said sample passage; seal means on the lower portion of said housing structure above the lower end of said bit means and having a diameter substantially corresponding to the diameter of the bore hole; and means for directing fluid into the bore hole externally of said housing structure adjacent to the upper and lower ends of said seal means to provide a zone of substantially static fluid around said seal means creating a fluid barrier to the movement of formation cuttings past said seal means; tubular means within said housing structure communicating with said sample passage to form an upward extension thereof; first means external of said tubular means for conducting fluid to said fluid discharging means; and second means external of said tubular means and bit means for conducting fluid to said fluid directing means; said tubular means defining an annular cylinder space with said housing structure; a hammer piston reciprocable in said cylinder space and adapted to impact against said bit means; and means for conducting fluid under pressure into said cylinder space alternately above and below said hammer piston for reciprocating said hammer piston.

7. Apparatus as defined in claim 6 and means for exhausting fluid under pressure from said cylinder space above said piston through said housing structure into the bore hole around said housing structure for upward flow around said housing structure and the tubular drill string.

8. Apparatus as defined in claim 6 said second means being communicable with said cylinder space below said piston to exhaust fluid therefrom for passage externally of said housing structure adjacent to the upper and lower ends of said seal means.

9. Apparatus as defined in claim 6 and means for exhausting fluid under pressure from said cylinder space above said piston through said housing structure into the bore hole around said housing structure for upward flow around said housing structure and the tubular drill string; said second means being communicable with said cylinder space below said piston to exhaust fluid therefrom for passage externally of said housing structure adjacent to the upper and lower ends of said seal means.

10. Apparatus as defined in claim 6 said second means being communicable with said cylinder space below said piston to exhaust fluid therefrom for passage externally of said housing structure adjacent to the upper and lower ends of said seal means; said first means including one or more choke orifices for decreasing the pressure of the fluid flowing to said fluid discharging means.

11. Apparatus for obtaining formation samples from the bottom of a bore hole: an outer housing structure having means thereon for securing said structure to a tubular drill string; bit means connected to said housing structure for producing formation cuttings to drill the bore hole to a desired diameter; said bit means having a sample passage therethrough for receiving the formation cuttings and for conducting such cuttings upwardly toward the tubular drill string; means for discharging fluid into the bore hole in the region of the bit means to convey the formation cuttings into said sample passage; seal means on the lower portion of said housing structure above the lower end of said bit means and having a diameter substantially corresponding to the diameter of the bore hole; and means for directing fluid into the bore hole externally of said housing structure adjacent to the upper and lower ends of said seal means to provide a zone of substantially static fluid around said seal means creating a fluid barrier to the movement of formation cuttings past said seal means; tubular means within said housing structure communicating with said sample passage to form an upward extension thereof; first means external of said tubular means for conducting fluid to said fluid discharging means; and second means external of said tubular means and bit means for conducting fluid to said fluid directing means; said first means including one or more choke orifices for decreasing the pressure of the fluid flowing to said fluid discharging means.

12. Apparatus for obtaining formation samples from the bottom of a bore hole: an outer housing structure having means thereon for securing said structure to a tubular drill string; bit means connected to said housing structure for producing formation cuttings to drill the bore hole to a desired diameter; said bit means having a central sample passage therethrough for receiving the formation cuttings; tubular means within said housing structure communicable with said sample passage to form an upward extension thereof and defining an annular cylinder with said housing structure; a hammer piston reciprocable in said cylinder for impacting against said bit means; means providing an inlet passage for high pressure fluid; means for conducting fluid from said inlet passage into said cylinder alternately above and below said hammer piston for reciprocating said hammer piston in said cylinder; first means for conducting fluid from said inlet passage for discharge into the bore hole in the region of the bit means to convey formation cuttings toward and into said sample passage for upward passage therethrough and through said tubular means; seal means on the lower portion of said housing structure having a diameter substantially corresponding to the diameter of the bore hole; and second means for directing fluid into the bore hole externally of the housing structure adjacent to the upper and lower ends of said seal means to provide a zone of substantially static fluid around said seal means creating a fluid barrier to the movement of formation cuttings past said seal means.

13. Apparatus as defined in claim 12; and means for exhausting fluid under pressure from said cylinder above said piston through said housing structure into the bore hole around said housing structure for upward flow around said housing structure and the tubular drill string.

14. Apparatus as defined in claim 12; said second means being communicable with said cylinder below said piston to exhaust fluid therefrom for passage externally of said housing structure adjacent to the upper and lower ends of said seal means.

15. Apparatus as defined in claim 12; and means for exhausting fluid under pressure from said cylinder above said piston through said housing structure into the bore hole around said housing structure for upward flow around said housing structure and the tubular drill string; said second means being communicable with said cylinder below said piston to exhaust fluid therefrom for passage externally of said housing structure adjacent to the upper and lower ends of said seal means.

16. Apparatus as defined in claim 12; said first means including one or more choke orifices for decreasing the pressure of the fluid discharged into the bore hole.

17. Apparatus as defined in claim 12; said second means including upper and lower ports in the housing structure opening into the bore hole above and below said seal means, respectively.

18. Apparatus as defined in claim 12, said first means including one or more choke orifices for decreasing the pressure of the fluid discharged into the bore hole; said second means including upper and lower ports in the housing structure opening into the bore hole above and below said seal means, respectively.

19. Apparatus as defined in claim 12; said first means including one or more choke orifices for decreasing the pressure of the fluid discharged into the bore hole; said second means including upper and lower ports in the housing structure opening into the bore hole above and below said seal means, respectively; and means for exhausting fluid under pressure from said cylinder above said piston through said housing structure into the bore hole around said housing structure for upward flow around said housing structure and the tubular drill string.

20. Apparatus as defined in claim 12; said first means including one or more choke orifices for decreasing the pressure of the fluid discharged into the bore hole; said second means including upper and lower ports in the housing structure opening into the bore hole above and below said seal means, respectively; said second means being communicable with said cylinder below said piston to exhaust fluid therefrom for passage externally of said housing structure adjacent to the upper and lower ends of said seal means.

21. Apparatus as defined in claim 12; said first means including one or more choke orifices for decreasing the pressure of the fluid discharged into the bore hole; said second means including upper and lower ports in the housing structure opening into the bore hole above and below said seal means, respectively; and means for exhausting fluid under pressure from said cylinder above said piston through said housing structure into the bore hole around said housing structure for upward flow around said housing structure and the tubular drill string; said second means being communicable with said cylinder below said piston to exhaust fluid therefrom for passage externally of said housing structure adjacent to the upper and lower ends of said seal means.

* * * * *